United States Patent [19]

Batteux et al.

[11] Patent Number: 4,622,529

[45] Date of Patent: Nov. 11, 1986

[54] OPERATING MECHANISM FOR A LOW VOLTAGE MULTIPOLE CIRCUIT BREAKER

[75] Inventors: Pierre M. Batteux, Vizille; Robert M. Denis, Grenoble, both of France

[73] Assignee: Merlin Gerin, Grenoble, France

[21] Appl. No.: 657,197

[22] Filed: Oct. 3, 1984

[30] Foreign Application Priority Data

Oct. 21, 1983 [FR] France ..... 83 17017

[51] Int. Cl.[4] ..... H01H 73/02

[52] U.S. Cl. ..... 335/21

[58] Field of Search ..... 335/21-25, 335/172, 17, 20

[56] References Cited

U.S. PATENT DOCUMENTS 2,669,627 2/1954 Gelzheiser .
2,783,330 2/1957 Casey .
2,806,103 9/1957 Geizheiser .
4,209,761 6/1980 Klein et al. ..... 335/17
4,274,069 6/1981 Troebel et al. ..... 335/21

*Primary Examiner*—L. T. Hix
*Assistant Examiner*—Brian W. Brown
*Attorney, Agent, or Firm*—Parkhurst & Oliff

[57] ABSTRACT

This invention relates to a circuit breaker operating mechanism.

The base (70) of the handle (52) moves along grooves or edges (78, 80) on the fixed guiding part formed by the mechanism support plates (40, 42). The grooves (78, 80) determine the trajectory and the fictitious pivoting axis of the handle (52) accurately. Rollers (74, 76) are fitted between the base (70) and the grooves (78, 80) to reduce the friction forces. The switch bar (28) comprises a projection located close to each electrical auxiliary so as to give a remote indication of the state of the circuit breaker and to cause automatic resetting of the auxiliary releases following tripping.

8 Claims, 12 Drawing Figures

OPERATING MECHANISM FOR A LOW VOLTAGE MULTIPOLE CIRCUIT BREAKER

BACKGROUND OF THE INVENTION

This invention relates to an operating mechanism of a multipole circuit-breaker having a molded insulating housing, said mechanism being mounted between two parallel support plates and comprising:

- a manual operating handle with an extended base located inside the housing between the mechanism and a cover of said housing,
- a toggle device associated with an automatic trip lever and with a switch bar common to all the poles,
- a stored energy spring fitted between the handle and the knee of the toggle,
- a device for latching the trip lever in the set position,
- a trip bar which can be either in an "inactive" position or in a trippped position to respectively latch and unlatch the trip lever,
- and tripping means operating with trip bar when a fault occurs or an external order is given.

Such a known circuit-breaker is disclosed in U.S. Pat. No. 4,274,069.

The handle is supported by an auxilary lever pivoting on a fixed pivot pin secured to the mechanism support plates. The handle trajectory has a small pivoting radius due to the presence of the axis of the lever inside the housing. The trip bar is mounted outside the trajectory of the handle, resulting in an increase in size of the insulating housing.

The presence of this pivoting lever also increases the friction of the movable assembly requiring a great deal of effort to operate the handle.

The object of the invention is to provide a circuit-breaker with a compact housing fitted with a simple mechanism permitting reduced friction of the moving parts of the movable assembly.

SUMMARY OF THE INVENTION

In the mechanism according to the invention, an extended base of the handle moves along upper edges arranged on the support plates of the mechanism. The edges have an inclined guiding surface which determines the trajectory of the pivoting movement of the handle, having a fictitious pivoting axis located near the lower bottom wall of said housing. The edges may also be straight and parallel to the housing base if the handle has a sliding movement.

Rollers can be mounted between the lower face of the handle base and the upper edges of the support plates to reduce the friction forces. Each roller has an axial length which is slightly greater than the transverse clearance between the support plates.

The absence of any additional pivoting handle support part enables the friction of the mechanism moving parts to be reduced to a minimum. The fictitious pivoting axis of the handle can be located outside the housing, which enables the pivoting radius of the handle to be increased. This radius is perfectly defined by the dimensional characteristics of the edges, with the result that the opposite ends of the handle base cover respectively the switch member and the trip member when the handle is in its pivoting travel end positions. The overall dimensions of the circuit-breaker housing are thus reduced to a minimum.

The pivot pin of the toggle rests on a cam extending along a lower edge of the trip lever. This results in a variation in the opening travel of the contact arms due to a different rotation of the switch bar when manual opening takes place or when opening is by automatic tripping. The travel of the contact arms is greater when tripping occurs.

This variation in the opening travel is advantageously used to actuate, by means of the switch bar, the different electrical auxiliaries fitted on either side of the mechanism.

BRIEF DESCRIPTION OF THE DRAWINGS

Other advantages and features of the invention will be best understood from the following detailed description thereof when read in conjunction with the accompanying drawings.

DESCRIPTION OF THE PREFERRED EMBODIMENT

Figure 1:
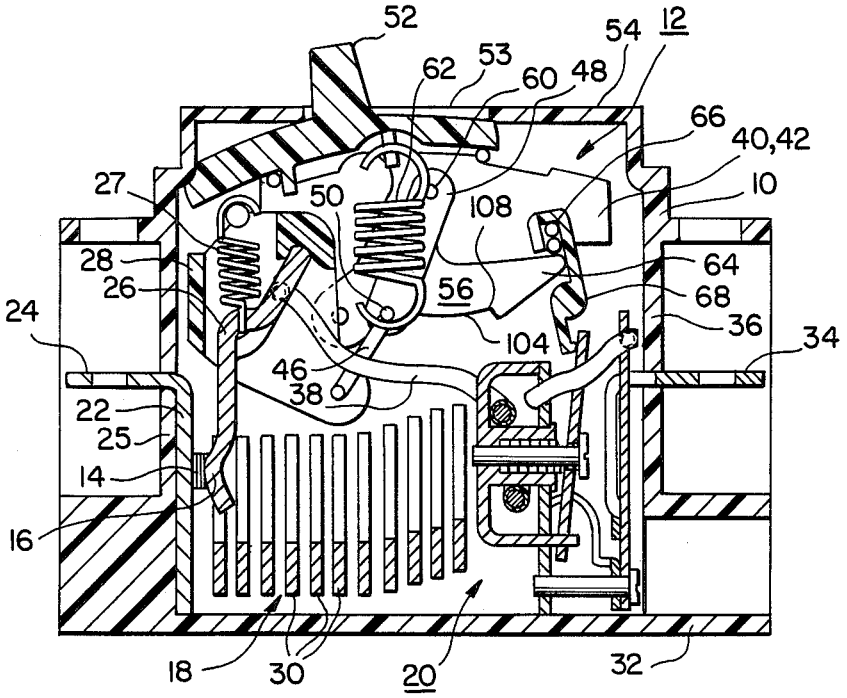
FIG. 1 is a side elevational view of a circuit breaker equipped with a mechanism embodying the principles of the invention, the breaker being shown in the closed position F.
Figure 2:
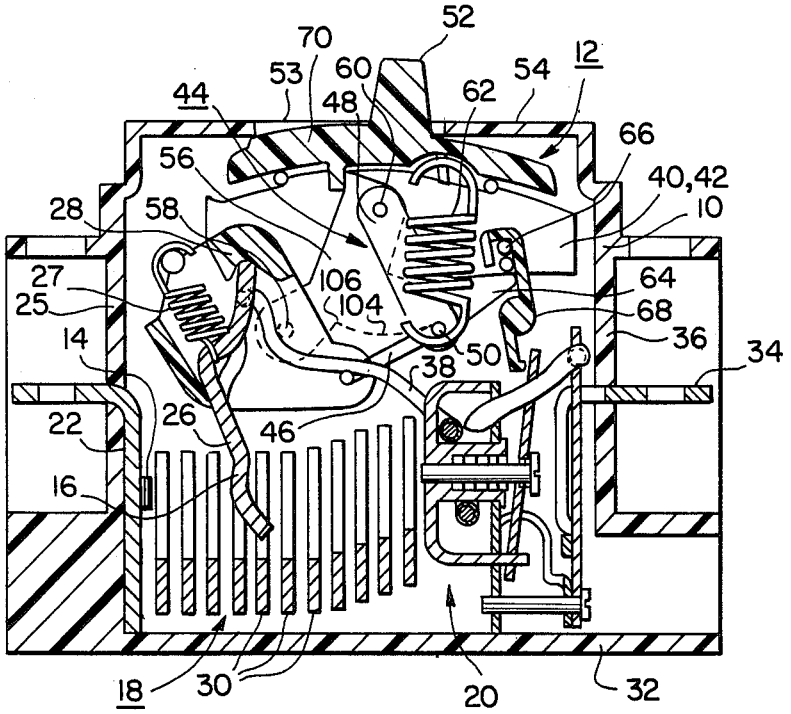
FIGS. 2 and 3 are similar views to FIG. I, but showing the mechanism respectively in the manually open position O and in the automatic tripped position on a fault O/D.
Figure 3:
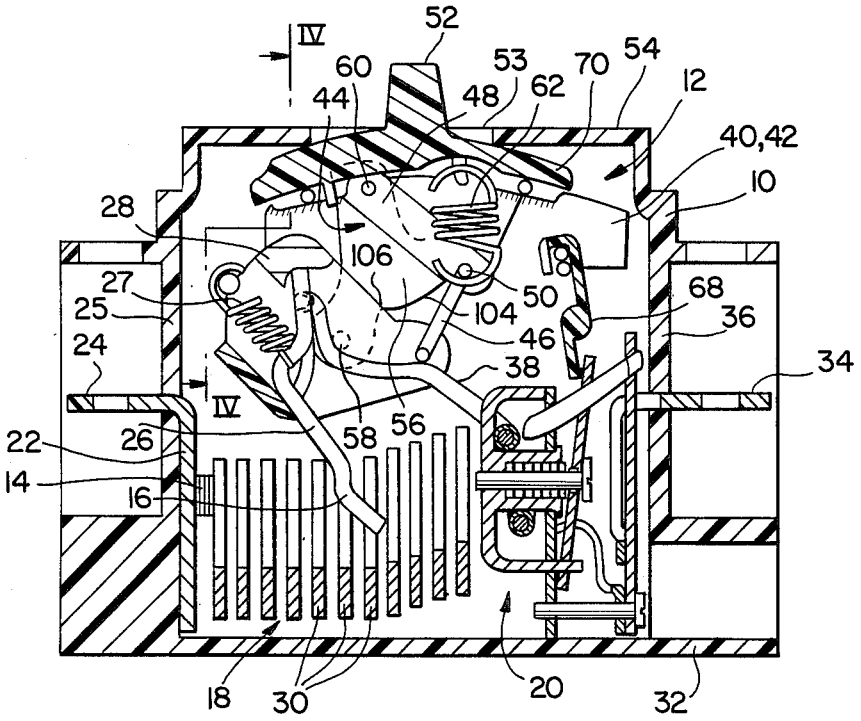

Referring to FIGS. 1 to 3 of the drawings, a three-pole low voltage circuit breaker is enclosed in a rectangular housing 10 of molded insulating material containing an operating mechanism bearing the general reference 12. The three poles are housed in compartments situated side by side in the lower part of the housing 10 and the mechanism 12 is mounted above the central pole in the upper part of the housing 10.

Each pole comprises a pair of separable contacts 14, 16, an arc extinction chamber 18 and a thermomagnetic release 20. The stationary contact 14 is mounted on a conductor 22 the end of which extends outside the lateral face 25 of the housing 10 forming a first contact pad 24. The movable contact 16 is fitted at the end of a vertical contact arm 26 secured by a spring 27 to a switch member or bar 28 common to the three poles. The support member 28 is mounted in limited rotation between the circuit breaker open and closed positions and extends crosswise above the poles in the upper part of the housing 10 in a perpendicular direction to the movable contact arms 26. The arc extinction chamber 18 comprises a stack of metal separators or deionization sheets 30 fitted perpendicularly to the base 32 of the housing 10.

The second contact pad 34 of each pole projects out of the opposite side face 36 of the housing 10, and is electrically connected to the thermomagnetic release 20, the latter being mounted between the arc extinction chamber 18 and the side face 36. The contact arm 26 is electrically connected to the second contact pad 34 by means of a flexible conductor in the form of a strap 38 inside an insulated cladding not shown in the drawings. The insulation of strap 38 constitutes a functional insulation of mechanism 12 from the live parts of each pole.

The mechanism 12 is mounted above the central pole, between the two support plates 40, 42 fitted parallel in the lengthwise direction of the alignment of the contact pads 24, 34. The switch member 28 is actuated by means of a toggle 44 comprising a lower rod 46 and an upper rod 48 both pivoting on a pivot pin 50. The toggle 44 operates on the one hand with a manual operating handle 52 extending outwardly through an opening 53 in cover 54, and on the other hand with an automatic tripping lever or hook 56 pivotally mounted on a pivot pin 58. The lower rod 46 is mechanically coupled with the switch member 28 and the upper rod 48 pivots on a pivot pin 60 arranged on the tripping lever 56. The toggle 44 and the handle 52 are connected mechanically in an elastic manner by means of a traction spring 62 one end of which is secured to the toggle 44 pivot pin 50, and the other end is hooked over a lug attached to the handle 52.

Opposite the pivot pin 58, the trip lever 56 has a latching nose 64 operating in the set position with a latch 66 of a trip member or bar 68 made of insulating material, common to all three poles. The trip member 68 extends above the thermomagnetic release 20 of each pole in a parallel direction to the switch member 28, and is mounted in limited rotation between a set position where the latching nose 64 of lever 56 is locked by the latch 66 and a tripped position releasing lever 56 by unlocking the latch 66. The rotating member 68 moves from the set position to the tripped position in a clockwise direction commanded either by the thermomagnetic release 20 in the event of an overload current or short-circuit current, or by an auxiliary release, in particular an undercurrent relay, so as to cause automatic tripping of the mechanism 12 and opening of the contacts 14, 16 of the three poles by rotation of the switch member 28 in a counterclockwise direction. The trip member 68 latch 66 is biased to the closed position by means of a return spring (not shown).

Figure 4:
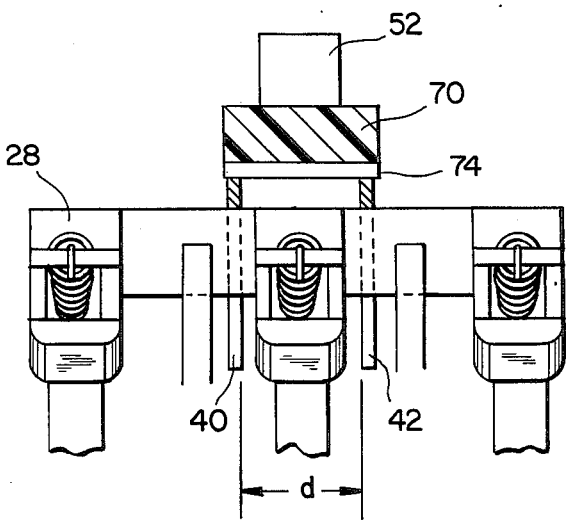
FIG. 4 is a partial sectional view of the mechanism taken along line IV—IV of FIG. 3.

The handle 52 has an extended base 70 located inside the housing 10 between the mechanism 12 and the cover 54. The curved lower face 72 of the base 70 rests on a fixed guiding part 73 formed by the upper edges of the two mechanism 12 support plates 40, 42 with two rollers 74, 76 placed between them (see FIGS. 4 and 5). Each support plate 40, 42 is fitted with two arcuate or inclined grooves 78, 80 on which the rollers 74, 76 roll when the handle 52 moves. The dimensional characteristics of the grooves 78, 80 enable the radius of travel and the pivoting point M of the handle 52 to be accurately determined, point M being the plotting of a fictitious rotation axis situated in FIG. 5 close to the base 32 of housing 10, at the intersection of the two radii XX', YY' passing through a point on the grooves 78, 80. The position of the pivoting point M of handle 52 depends on the curvature radius of the grooves 78, 80, and end of travel stops 82, 84 are located at the end of each groove 78, 80 to control the end of pivoting travel positions of handle 52. The presence of the rollers 74, 76 reduces the friction forces generated when the handle 52 moves, each roller 74, 76 having an axial length slightly greater than the transverse clearance d between the support plates 40, 42 (FIG. 4). The non-material pivoting point M of handle 52 can be outside the housing 10 which enables the height of housing 10 between the base 32 and the cover 54 to be reduced to a minimum.

In an alternative embodiment, the grooves 78, 80 on the upper edges of the support plates 40, 42 are straight and extend parallel to the base 32 of the housing. The handle base 70 is also straight and operates with the grooves to impose a limited translation movement of the handle 52 when the latter moves between the open and closed positions.

Figure 6:
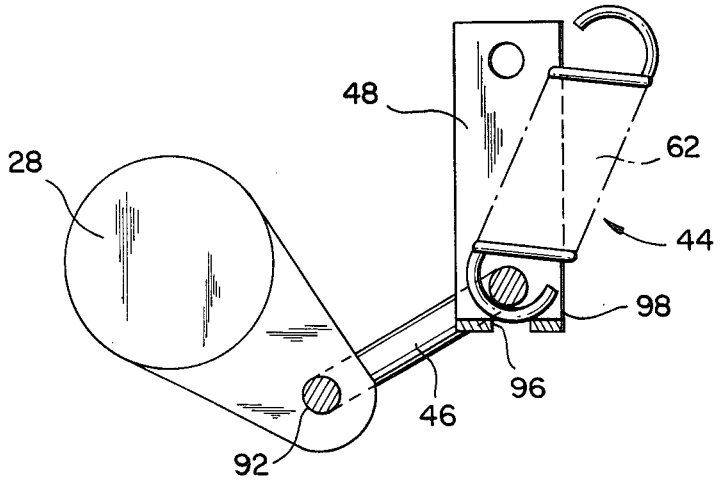
FIG. 6 is a sectional view of the toggle coupled to the member.
Figure 7:
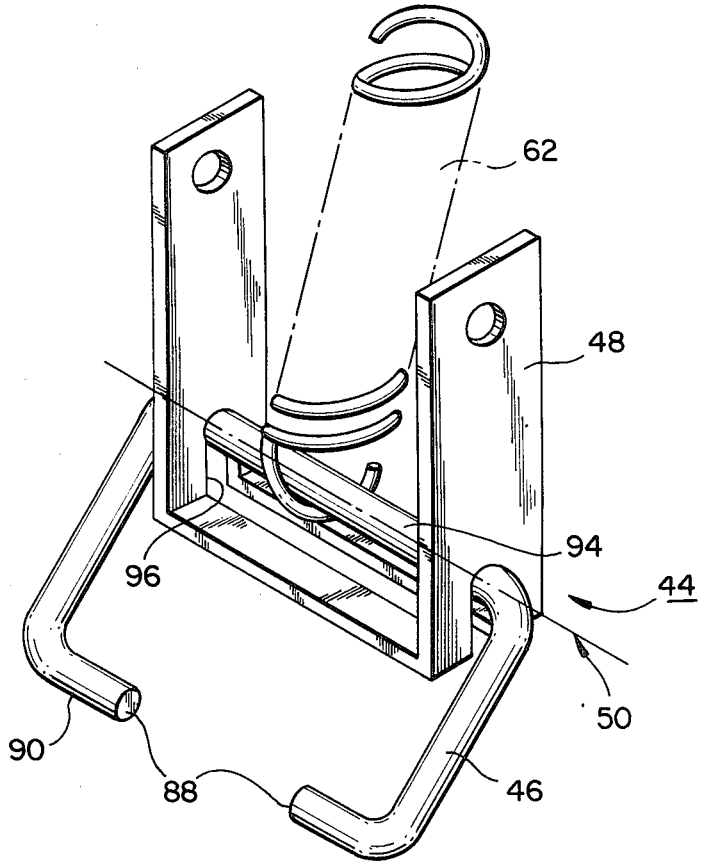
FIG. 7 is a perspective view of the toggle as in FIG. 6.

In FIGS. 6 and 7, the lower rod 46 of the mechanism 12 toggle 44 is formed by a circular cross-section steel wire open rectangular loop. The ends 88 of the open branch 90 of the loop are engaged in an opening 92 in the switch member 28. The opposite branch 94 of the lower rod 46 is positioned in a half-open notch 96 in a U-clamp 98 constituting the upper rod 48. The trip spring 62 of mechanism 12 is hooked over the branch 94 and the handle 52 and holds the branch 94 firmly in the notch 96, so as to form the pivot pin 50 of the toggle 44.

Figure 8:
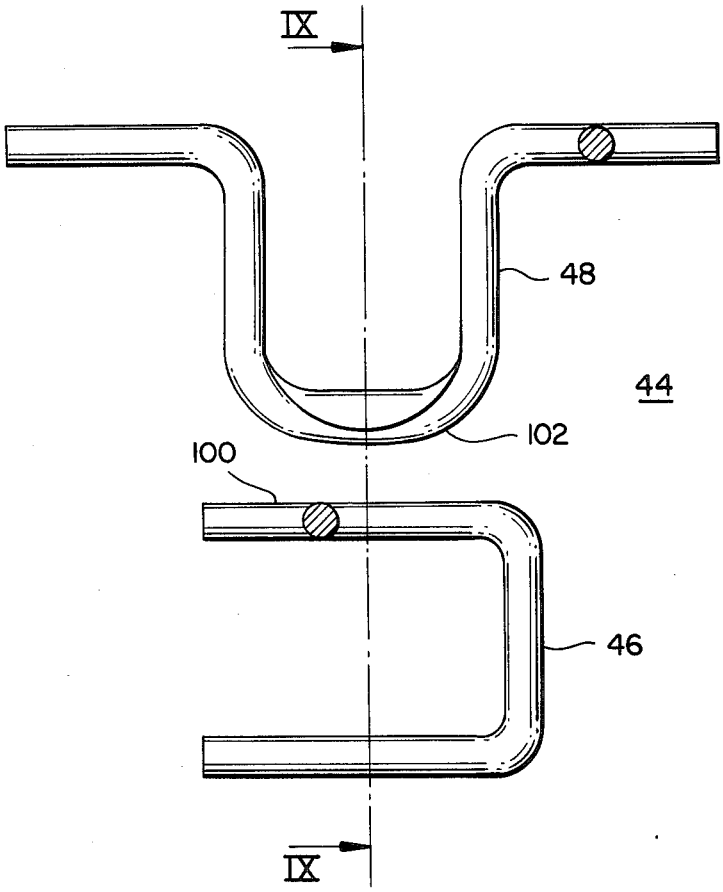
FIG. 8 shows an alternative embodiment of the toggle in the uncoupled position.
Figure 9:
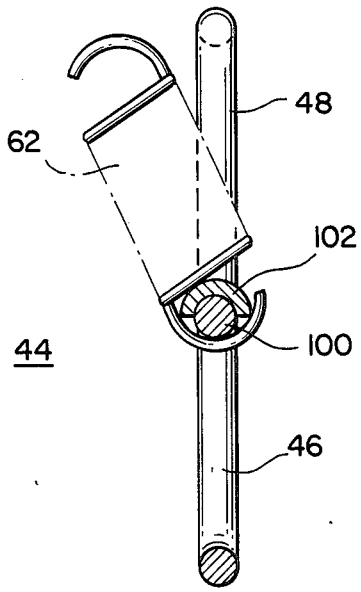
FIG. 9 is a sectional view taken along line IX—IX of FIG. 8, with the toggle in the mounted position.

FIGS. 8 and 9 show a variation of the toggle 44 in which each rod 46, 48 is U-shaped and made of circular cross-section steel wire. One of the lateral branches 100 of the lower rod 46 is held by the traction spring 62 in a crescent-shaped part 102 of the upper rod 48.

It can be seen in FIGS. 1 to 4 that the opposite ends of the handle base 70 cover respectively the switch member 28 and the trip member 68 when the handle 52 is in its end of pivoting travel positions. This results in a reduction in the size of the housing 10 in the lengthwise direction of the poles.

The toggle 44 pivot pin 50 moves along a cam 104 on the curved lower edge of the trip lever 56, said edge running between the pivot pin 58 and the latching nose 64 opposite the pivot pin 60 of the upper rod 48. The cam 104 of lever 56 is limited by two notches 106, 108 acting as stops for the toggle 44 pivot pin 50 when the contacts 14, 16 of the poles are respectively in the open and closed position.

Figure 5:
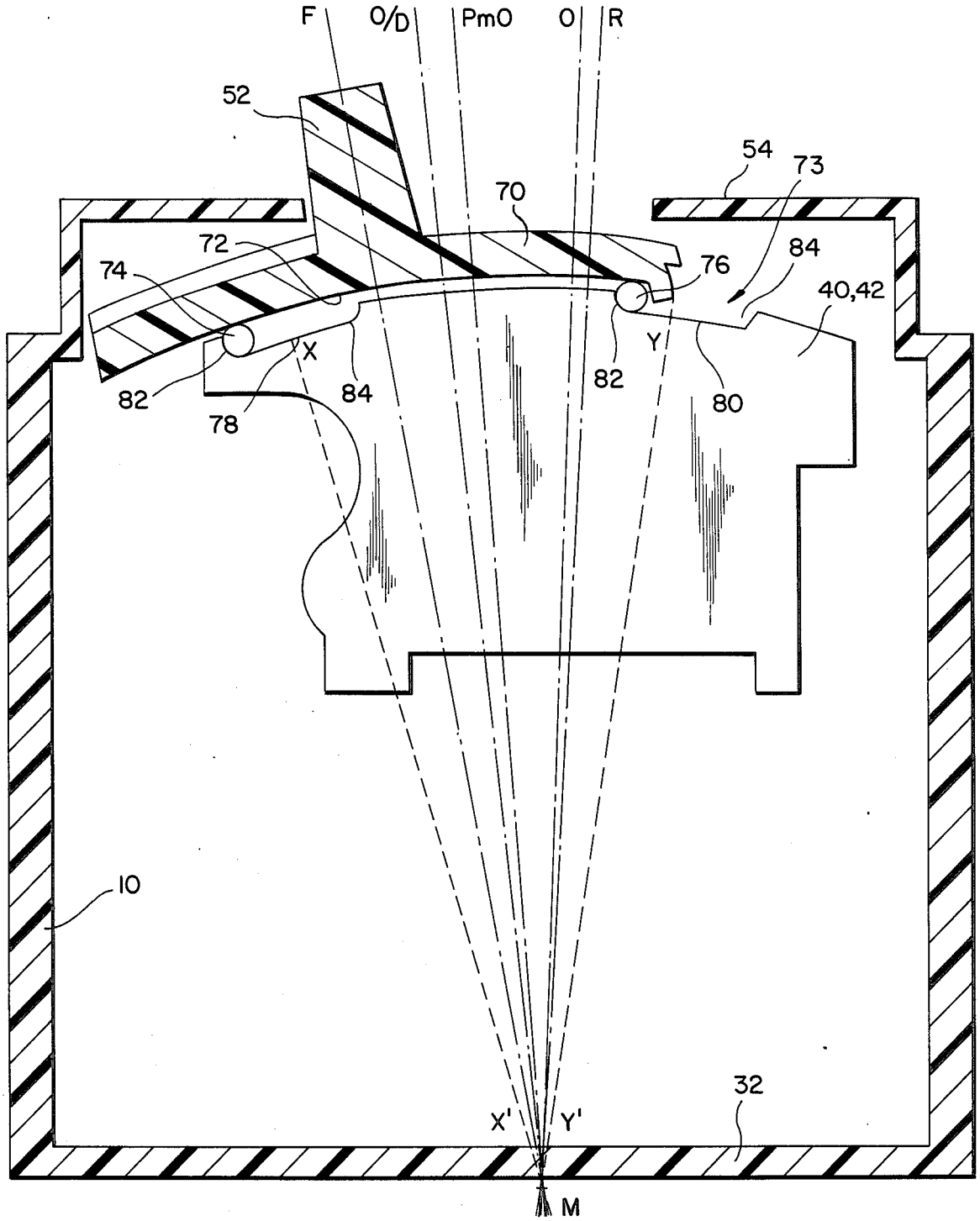
FIG. 5 shows a simplified enlarged scale view of FIG. I, only the handle and the mechanism support plates being represented.

The mechanism as shown in FIGS. I to 5 operates as follows:

FIG. 5 shows a diagrammatic indication of the different positions occupied by the pivoting handle 52 when operated manually or when the mechanism 12 trips automatically on a fault:

closed position F of circuit breaker contacts,
open position O/D of contacts following an automatic trip on a fault,
non-stable position P m O corresponding to the opening dead point of mechanism 12,
manual opening position O of the contacts,
reset position R of mechanism 12.

In the closed position F (FIG. 1), the trip lever 56 is locked in the set position by the latch 66, and the toggle 44 pivot pin 50 is positioned in the first notch 106 of cam 104.

When the circuit breaker is opened manually (FIG. 2) by moving the handle 52 from the position F to the position O, the trip lever 56 remains stationary in the set position, and the toggle pivot pin 50 moves along the cam 104 until it comes up against the stop formed by the second notch 108. The blocking of toggle 44 by the trip lever 56 prevents further countercloskwise rotation of the switch bar 28 and contact arms 26.

Following tripping on a fault, the release of latch 66 by the trip member 68 frees the latching nose 64 of the trip lever 56 causing said lever 56 to pivot counterclockwise around the pivot pin 58. The toggle 44 moves the handle 52 from the position F to the intermediate position O/D. The toggle 44 knee 50 is engaged in the second notch 108 of cam 104, and the toggle 44 follows the movement of the trip lever 56 (FIG. 3) to the tripped position. This results in the opening travel of the contact arms 26 following tripping being greater than the travel on manual opening. This increased travel of the switch bar 28 and contact arms 26 (FIG. 3) in the event of tripping on a fault enables the breaking capacity of the circuit breaker to be improved.

The circuit breaker is reset by actuating the handle 52 clockwise from the position O/D to the reset position R next to the position O to ensure latching of the trip lever 56 with the latch 66. The circuit breaker contacts are then closed (FIG. 1) by rotating the handle 52 manually in the opposite direction until it reaches the position F.

Electrical control and indication auxiliaries are fitted on either side of the mechanism 12 in the upper part of the housing 10. The role of the indication auxiliaries is to give a remote indication of the state of the circuit breaker. They comprise:

- a first system of double-throw contacts OF giving a remote indication of the closed F and manually opened O positions of the circuit breaker;
- a second system of auxiliary contacts SD indicating a fault following automatic tripping of the mechanism 12.

The control auxiliaries are comprised of auxiliary releases, particularly of the undervoltage MN and/or shunt trip MX type, designed to cause unlatching of latch 66 to trip mechanism 12 following the absence of voltage in the distribution system or a remote order to open the circuit breaker. The variation of the opening travel of the contact arms 26 occurring due to a different rotation of the switch member 28, depending on whether the order is manual or automatic on a fault, is advantageously used to actuate the different electrical auxiliaries. The switch member 28 comprises for this purpose a projection 110 (FIGS. 10 and 11) located close to each auxiliary.

Figure 10:
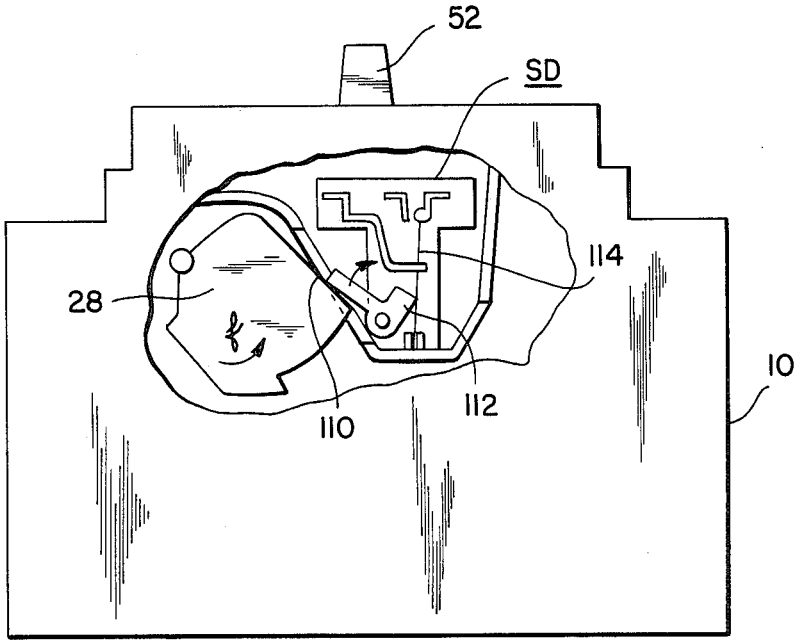
FIG. 10 is a partial exploded view of FIG. 5, showing a system of remote fault signalling auxiliary contacts SD.

In FIG. 10, the projection 110 of switch member 28 operates, with the handle 52 in the position O/D, on a transmission lever 112 designed to actuate the double-throw contact 114 of the second system of SD contacts for remote indication of tripping on a fault.

Similarly, the projection 110 associated with the first system of auxiliary OF contacts (not shown) would actuate the corresponding double-throw contact 114 if the handle 52 was in the manually opened position O. The double-throw contact 114 of the first OF system is therefore operated prior to that of the second SD system due to the different travel of the member 28 in the direction of the arrow f.

Figure 11:
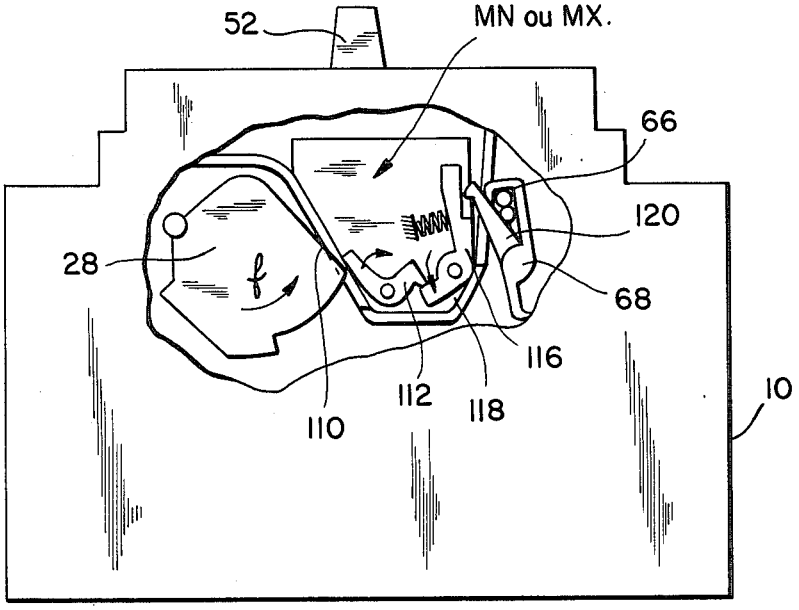
FIG. 11 is a view similar to FIG. 10, showing an auxiliary MN or MX release of the mechanism.
Figure 12:
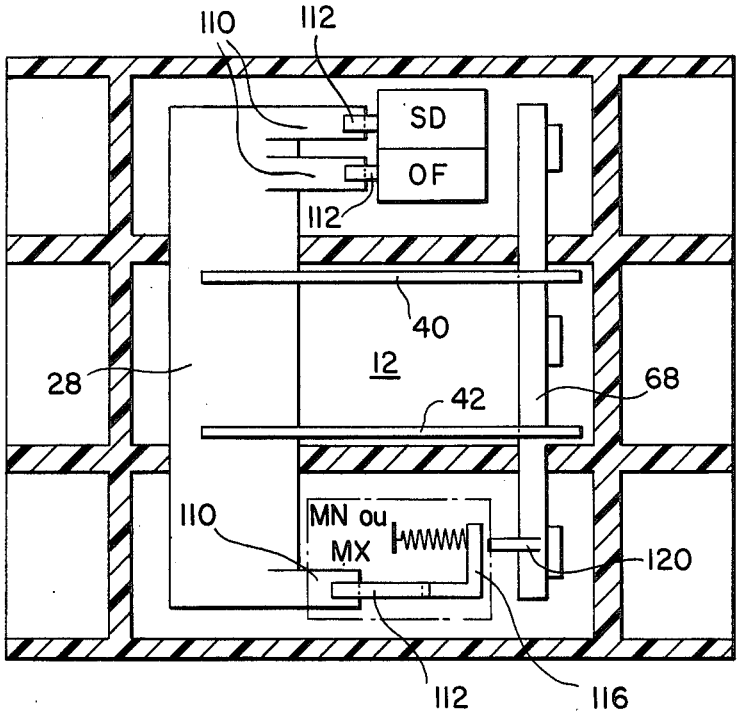
FIG. 12 is a horizontal sectional view of the circuit breaker as in FIG. IO or II, with the cover removed.

In FIG. 11, an auxiliary MN or MX release has an elbow-shaped operating lever 116 pivotally mounted on a pivot pin 118. One of the ends of the operating lever 116 acts on a protuberance 120 of the trip member 68, and the opposite end is in contact with the transmission lever 112.

When the mechanism 12 is tripped by the auxiliary release MN or MX, the operating lever 116 pivots clockwise and moves the trip member 68 to the tripped position. When the handle 52 reaches the intermediate position O/D, the projection 110 of the member 28 actuates the levers 112, 116 in the direction of the arrows f to carry out automatic resetting of the auxiliary release MN or MX. This automatic resetting by the switch member is impossible with the handle 52 in the position O.

We claim:

1. An operating mechanism for an electric multipole circuit-breaker having a molded insulating housing including a lower bottom wall, and an upper cover wall, said mechanism comprising in combination:

- a pivotal manual operating handle comprising an extended base, located inside said housing between the mechanism and the upper cover wall;
- two stationary parallel support plates extending in a longitudinal direction, and having upper edges forming a fixed guiding part cooperating with said extended base of said handle upon moving of the handle along a pivoting movement in said longitudinal direction;
- a toggle device including a lower rod and an upper rod, both pivoting on a pivot pin, so as to constitute a knee of said toggle;
- a transverse switch bar which is common to all the poles and mechanically coupled with the lower rod of said toggle device;
- a pivotal trip lever articulated to the upper rod of said toggle device;
- a stored energy spring fitted between the handle and the pivot pin of said toggle; and
- said edges of said fixed guiding part having an inclined surface which determines the trajectory of the pivoting movement of said handle, said handle having a fictitious pivoting axis located near the lower bottom wall of said housing.

2. An operating mechanism according to claim 1, wherein roller means are mounted between the extended base of said handle and the upper edges of the support plates for reducing the friction forces generated upon pivoting of said handle.

3. An operating mechanism according to claim 2, wherein the edges of said support plates comprise guiding grooves along which roll said roller means, said roller means extending in a transverse direction, so that each roller means includes a cylindrical pin having an axial length slightly greater than the transverse clearance between the two stationary support plates.

4. An operating mechanism according to claim 1, wherein the lower rod of said toggle device comprises a circular cross-section steel wire branch, engaged in a notch in the upper rod, so as to constitute the pivot pin of the toggle knee.

5. An operating mechanism for an electric multipole circuit-breaker having a molded insulating housing including a lower bottom wall, and an upper cover wall, said mechanism comprising in combination:

- a slidable manual operating handle comprising an extended base located inside said housing between the mechanism and the upper cover wall;
- two stationary parallel support plates extending in a longitudinal direction, and having upper edges forming a fixed guiding part cooperating with said extended base upon moving of the handle alng a sliding movement in the longitudinal direction;

a toggle device including a lower rod and an upper rod, both pivoting on a pivot pin, so as to constitute a knee of said toggle;

a transverse switch bar which is common to all the poles and mechanically coupled with the lower rod of said toggle device;

a pivotal trip lever articulated to the upper rod of said toggle device;

a stored energy spring fitted between the handle and the pivot pin of said toggle; and said edges of said fixed guiding part having a straight surface which determines the linear sliding movement of said handle, said linear sliding movement extending in a direction parallel to the lower bottom wall.

6. An operating mechanism for an electric multipole circuit-breaker having a molded insulating housing including a lower bottom wall, and an upper cover wall, said mechanism comprising in combination;

a movable manual operating handle, comprising an extended base located inside said housing between the mechanism and the upper cover wall;

two stationary parallel support plates extending in a longitudinal direction, and having upper edges forming a fixed guiding part, cooperating with said extended base upon moving of the handle;

a toggle device including a lower rod and an upper rod, both pivoting on a pivot pin, so as to constitute a knee of said toggle;

a transverse switch bar which is common to all the poles and mechanically coupled with the lower rod of said toggle device;

a pivotal trip lever articulated to the upper rod of said toggle device;

a stored energy spring fitted between the handle and the pivot pin of said toggle;

a device for latching the trip lever in a set position;

a pivotal transverse trip bar which moves between an inactive position to latch the trip lever and a tripped position to unlatch said trip lever;

a release cooperating with the trip bar, said release being in the tripped position when a fault occurs;

a stop device cooperating with the toggle to ensure a variation of the opening travel of the contact arms due to a different rotation of the switch bar when opening by tripping on a fault; and electrical control and indication auxiliaries fitted on each side of the support plates of the mechanism and comprising first and second systems of auxiliary contacts for providing a remote indication of the state of the circuit-breaker and electromagnetic auxiliary releases, wherein the trip lever has a cam member cooperating with said toggle knee and wherein the switch bar has a projection located adjacent each electrical auxiliary, so as to actuate the first system of auxiliary contacts indicating manual opening before actuating the second system of auxiliary contacts indicating tripping on a fault, and to reset the auxiliary releases automatically following the tripping of the mechanism.

7. An operating mechanism according to claim 6, wherein said cam of the trip lever extends along a curved lower edge of said trip lever, and includes two stops located between a pivot pin and a latching nose of said trip lever.

8. An operating mechanism according to claim 6, wherein a transmission lever is fitted between the projection of said switch bar and said electrical control and indication auxiliaries.

* * * * *